US007775907B2

(12) United States Patent
Hirano

(10) Patent No.: US 7,775,907 B2
(45) Date of Patent: Aug. 17, 2010

(54) METHOD FOR MANUFACTURING GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 402 days.

(21) Appl. No.: 11/710,522

(22) Filed: Feb. 26, 2007

(65) Prior Publication Data

US 2007/0219018 A1 Sep. 20, 2007

(30) Foreign Application Priority Data

Mar. 16, 2006 (JP) ..... 2006-073119

(51) Int. Cl.
*A63B 53/00* (2006.01)

(52) U.S. Cl. ..... 473/349; 473/345

(58) Field of Classification Search ..... 473/349, 473/345

See application file for complete search history.

(56) References Cited

U.S. PATENT DOCUMENTS 5,294,037 A * 3/1994 Schmidt ..... 228/125
5,421,577 A * 6/1995 Kobayashi ..... 473/335
5,658,207 A * 8/1997 Aizawa et al. ..... 473/345
5,967,905 A * 10/1999 Nakahara et al. ..... 473/345
6,162,132 A * 12/2000 Yoneyama ..... 473/338
7,101,291 B2 9/2006 Yamamoto et al.
2003/0087710 A1 * 5/2003 Sheets et al. ..... 473/344
2004/0224790 A1 * 11/2004 Lu ..... 473/345
2005/0266930 A1 * 12/2005 Byrne et al. ..... 473/324
2006/0199665 A1 * 9/2006 Lo ..... 473/345
2006/0270490 A1 * 11/2006 Lo ..... 473/345

* cited by examiner

*Primary Examiner*—Gene Kim
*Assistant Examiner*—Matthew B Stanczak
(74) *Attorney, Agent, or Firm*—Birch, Stewart, Kolasch & Birch, LLP

(57) ABSTRACT

A method for manufacturing a hollow golf club head is disclosed, wherein a metallic main frame provided with a top opening and a bottom opening, a metallic crown plate and a metallic sole plate are prepared. The sole plate is placed in the bottom opening. A die is inserted into the inside of the main frame through the top opening. A protrusion of the sole plate is crushed onto the edge portion of the main frame around the bottom opening, by the use of the inserted die. Then the top opening is closed by the crown plate. The specific gravity SGm and proof stress YSm of the main frame, the specific gravity SGs and proof stress YSs of the sole plate, and the specific gravity SGf of the face plate satisfy: SGf=<SGm<SGs and YSs<YSm.

10 Claims, 7 Drawing Sheets

METHOD FOR MANUFACTURING GOLF CLUB HEAD

BACKGROUND OF THE INVENTION

The present invention relates to a method for manufacturing a golf club head, more particularly to a structure of the sole portion capable of lowering the center of gravity of the head.

In recent years, wood-type club heads for drivers and the like are increased in the volume, while preventing the weight from increasing. As a result, it becomes very difficult to set the center of gravity of the head at the desired position because there is almost no weight margin which can be utilized to adjust the position of the center of gravity of the head.

On the other hand, in the golfers, especially average golfers there are great demands for golf club heads with a low and deep center of gravity to produce a high launch angel with low spin for longer and straight drives.

In the U.S. Pat. No. 7,101,291, a wood-type hollow golf club head is disclosed, wherein a tubular socket is provided on the inside of the sole portion integrally with the sole plate, and a weight member is secured in the socket of the sole plate. In this structure, however, if the mass of the weight member is increased in order to lower and deepen the center of gravity of the head, as the tubular socket protrudes relatively high into the hollow of the head and the socket is filled with a heavy metal, a large stress acts on the root or lower part of the socket when striking a ball, especially when duffing a ball. Thus, the root part becomes a weak point, and in the worst case, the root part is cracked. As a result, the adjustable range of the position of the center of gravity is limited thereby.

A primary object of the present invention is therefore to provide a golf club head of which center of gravity is made lower and deeper by forming the sole portion with a sole plate having a large specific gravity.

A further object of the present invention is to provide a method for manufacturing a golf club head, by which the position of the center of gravity of the head can be adjusted in a wide range as desired and thus more lowing and deepening are possible without causing the weak point or damage.

According to one aspect of the present invention, a method for manufacturing a hollow golf club head comprises the steps of:

preparing a main frame made of a metal material and provided with a top opening and a bottom opening;

preparing a sole plate made of a metal material, wherein the metal material of the sole plate is larger in the specific gravity and smaller in the proof stress than the metal material of the main frame, and the sole plate comprises a main part which can almost fit to the bottom opening, and a protrusion which protrudes from the peripheral edge of an inner surface of the main part;

placing the sole plate in the bottom opening of the main frame so that the protrusion protrudes from the inner surface of an edge portion of the main frame around the bottom opening;

inserting a die into the inside of the main frame through the top opening;

caulking the sole plate by crushing the protrusion of the sole plate onto the edge portion around the bottom opening, by the use of the inserted die;

placing the crown plate in the top opening of the main frame; and fixing the crown plate to the main frame.

Preferably, the main part of the sole plate is provided with a variable thickness gradually increasing from the front to the rear of the head.

DEFINITIONS

The standard state of a golf club head is defined such that the head is placed on a horizontal plane HP so that the center line CL of the club shaft or shaft inserting hole 7*a* is inclined at the lie angle while keeping the center line CL on a vertical plane VP, and the club face forms its loft angle with respect to the vertical plane VP.

The sweet spot SS is defined as the point of intersection between the club face and a straight line N drawn normally to the club face passing the center G of gravity of the head.

DESCRIPTION OF THE PREFERRED EMBODIMENTS

Figure 1:
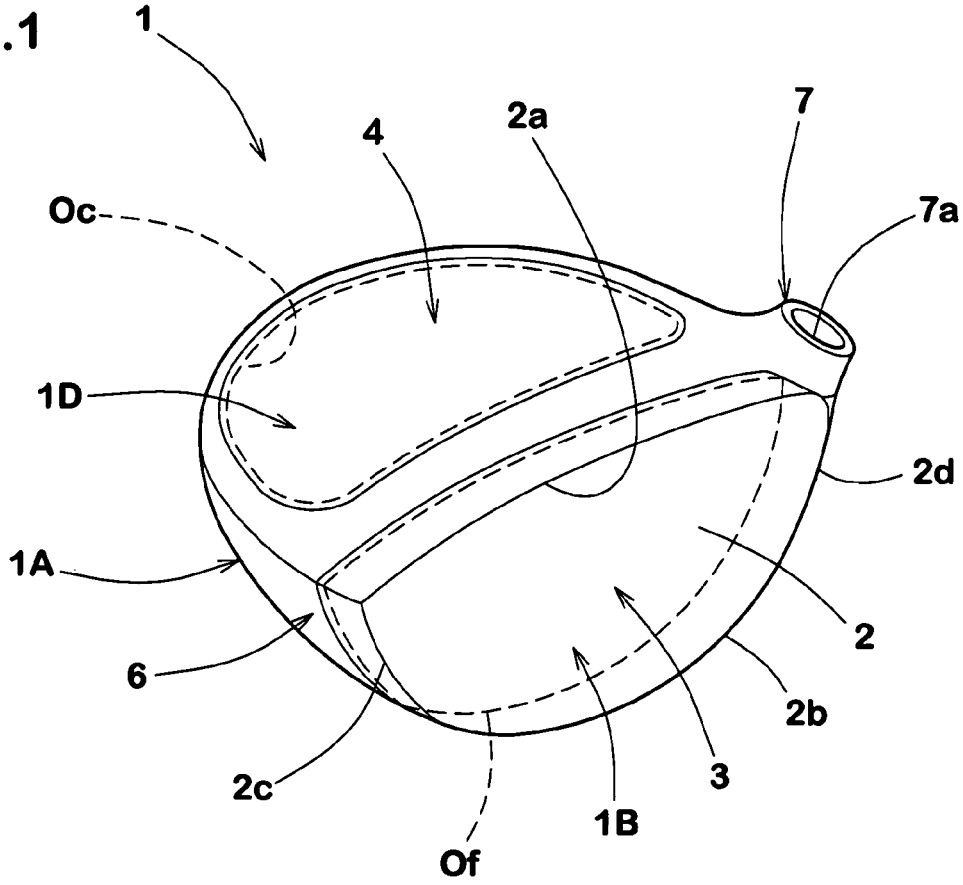
FIG. 1 is a perspective view of a wood-type hollow golf club head as an embodiment of the present invention.

Embodiments of the present invention will now be described in detail in conjunction with the accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

In the case of a wood-type club head for a driver (#1), it is preferable that the head volume is set in a range of not less than 350 cc, more preferably not less than 380 cc in order to increase the moment of inertia and the depth of the center of gravity. However, to prevent an excessive increase in the club head weight and deteriorations of swing balance and durability and further in view of golf rules or regulations, the head volume is preferably set in a range of not more than 460 cc.

The mass of the club head 1 is preferably set in a range of not less than 180 grams in view of the swing balance and rebound performance, but not more than 210 grams in view of the directionality and traveling distance of the ball.

The club head 1 is composed of a main frame 1A, a face plate 1B forming at least a major part of the face portion 3, a crown plate 1D forming a major part of the crown portion 4, and a sole plate 1C forming a part of the sole portion 5.

The main frame 1A is made of a metal material having a specific gravity SGm, the face plate 1B is made of a metal material-having a specific gravity SGf, the sole plate 1*c* is made of a metal material having a specific gravity SGs, and the crown plate 1D is made of a metal material having a specific gravity SGc.

In order to lower and deepen the center G of gravity, these four metal materials are different materials whose specific gravities SGm, SGf, SGs and SGc satisfy the following conditions:

$$SGf=<SGm<SGs \text{ and}$$

$$SGc<SGs.$$

Preferably, the following condition is further satisfied:

$$SGf<SGm.$$

Main Frame 1A

The main frame 1A is provided with three independent openings: a front opening of, a top opening Oc within the crown portion 4, and a bottom opening Os within the sole portion 5, which are closed by the face plate 1B, crown plate 1D and sole plate 1C, respectively.

Figure 2:
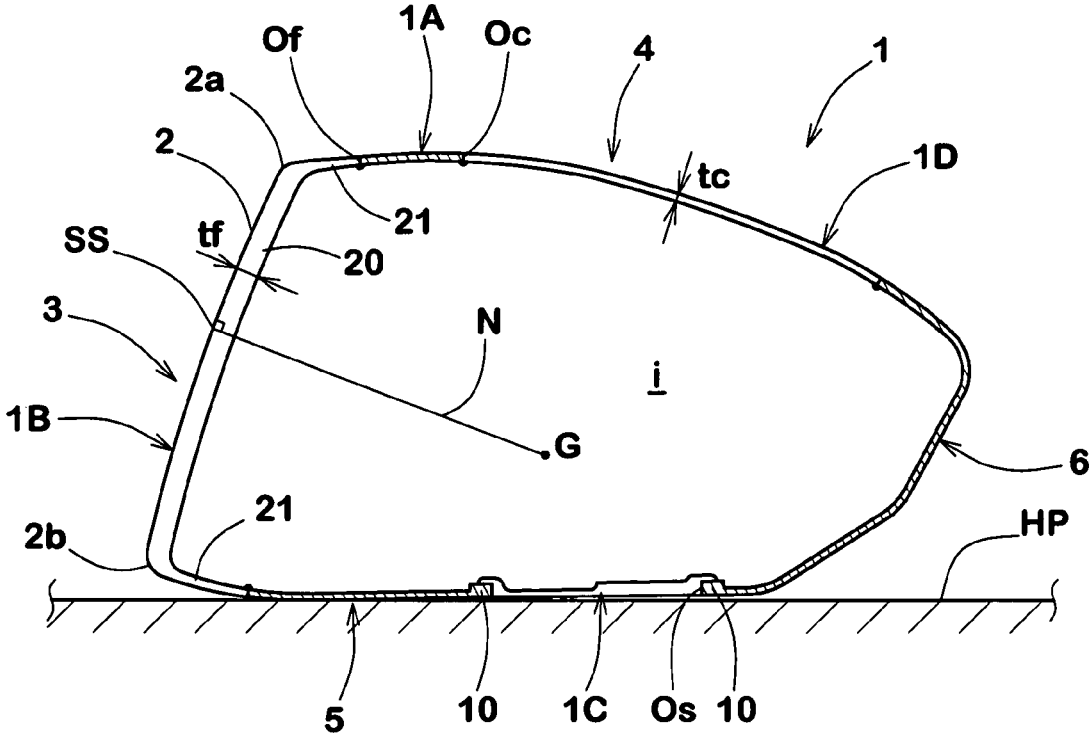
FIG. 2 is a cross sectional view thereof.
Figure 3:
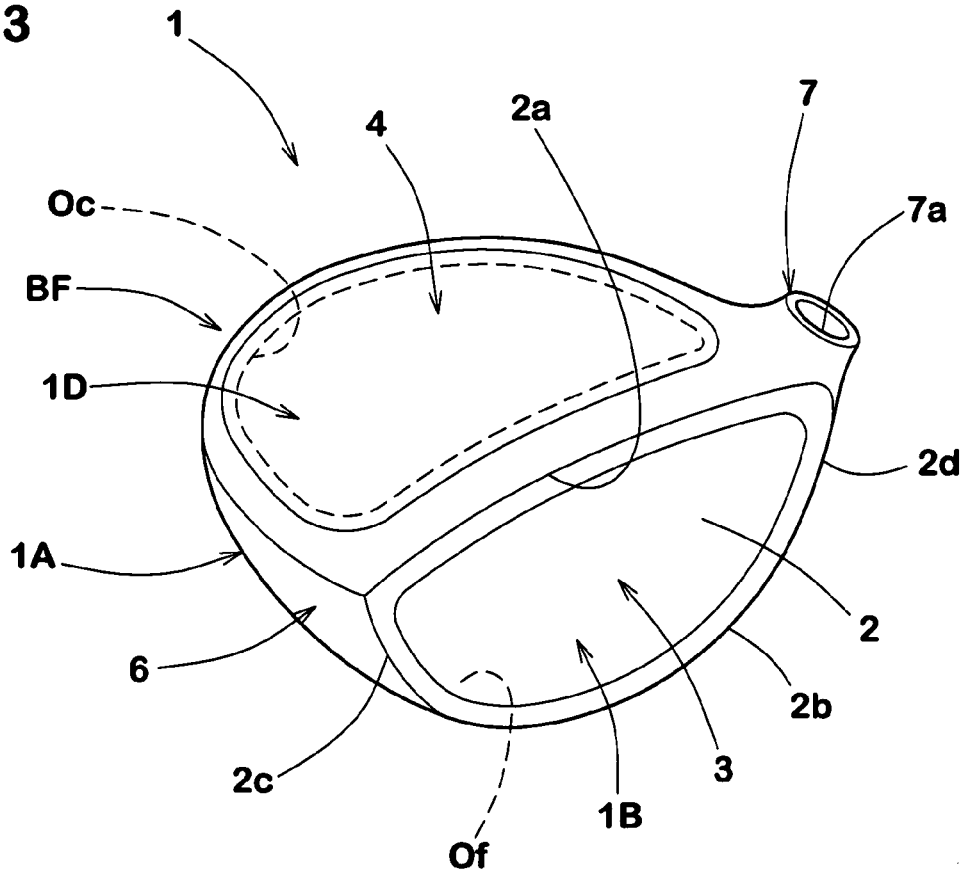
FIG. 3 is a perspective view of a wood-type hollow golf club head as another embodiment of the present invention.
Figure 4:
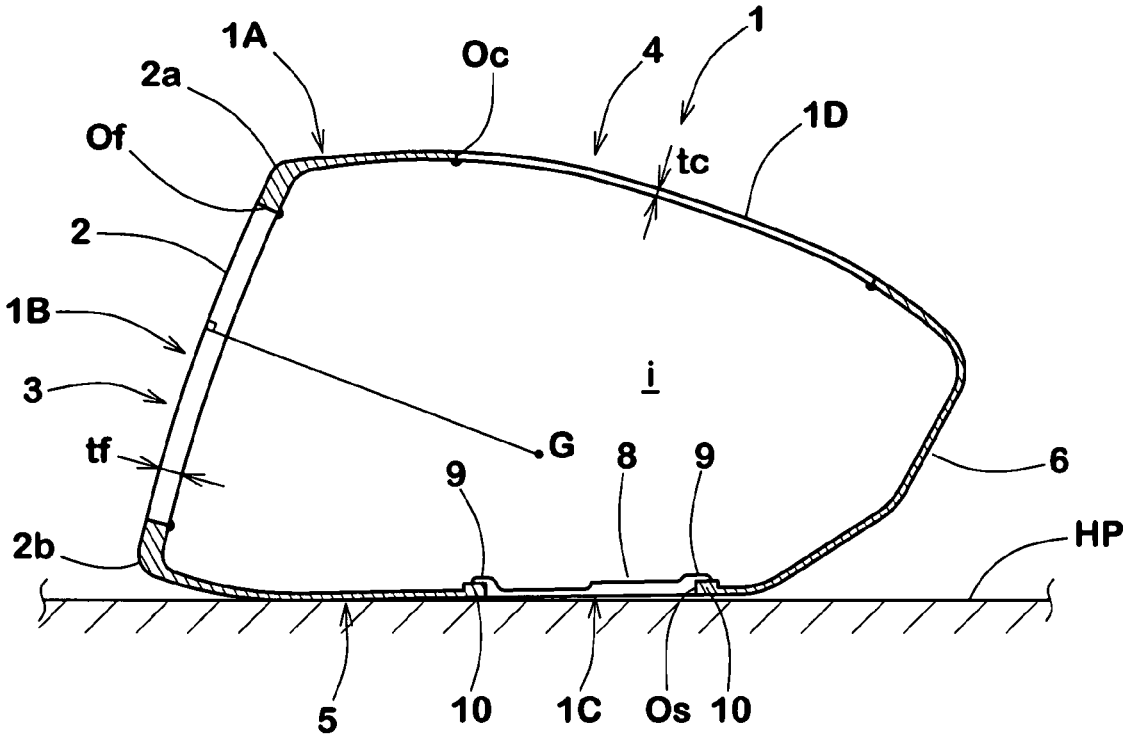
FIG. 4 is a cross sectional view of the second embodiment shown in FIG. 3.

In the case of FIGS. 1-2 showing the first embodiment in which the entirety of the face portion 3 is formed by the face plate 1B and the face plate 1B is integrally provided with a turnback 21, the main frame 1A includes: the above-mentioned hosel portion 7; a major part of the side portion 6 excepting a front part formed by the turnback 21; a crown peripheral part 4A surrounding the top opening Oc to form a part of the crown portion 4; and a sole peripheral part 5A surrounding the bottom opening Os to form a part of the sole portion 5.

In the case of FIGS. 3-6 showing the second embodiment in which the face plate 1B forms a major part of the face portion 3, the main frame 1A includes: the hosel portion 7; the side portion 6; a clubface peripheral part 3A surrounding the front opening to form a part of the face portion 3; a crown peripheral part 4A surrounding the top opening Oc to form a part of the crown portion 4; and a sole peripheral part 5A surrounding the bottom opening Os to form a part of the sole portion 5.

In these two embodiments, the top opening Oc and bottom opening Os are both formed within the crown portion 4 and sole portion 5, respectively, but, it may be possible to protrude each or one of them into the adjacent portion, usually, the side portion 6.

Figure 5:
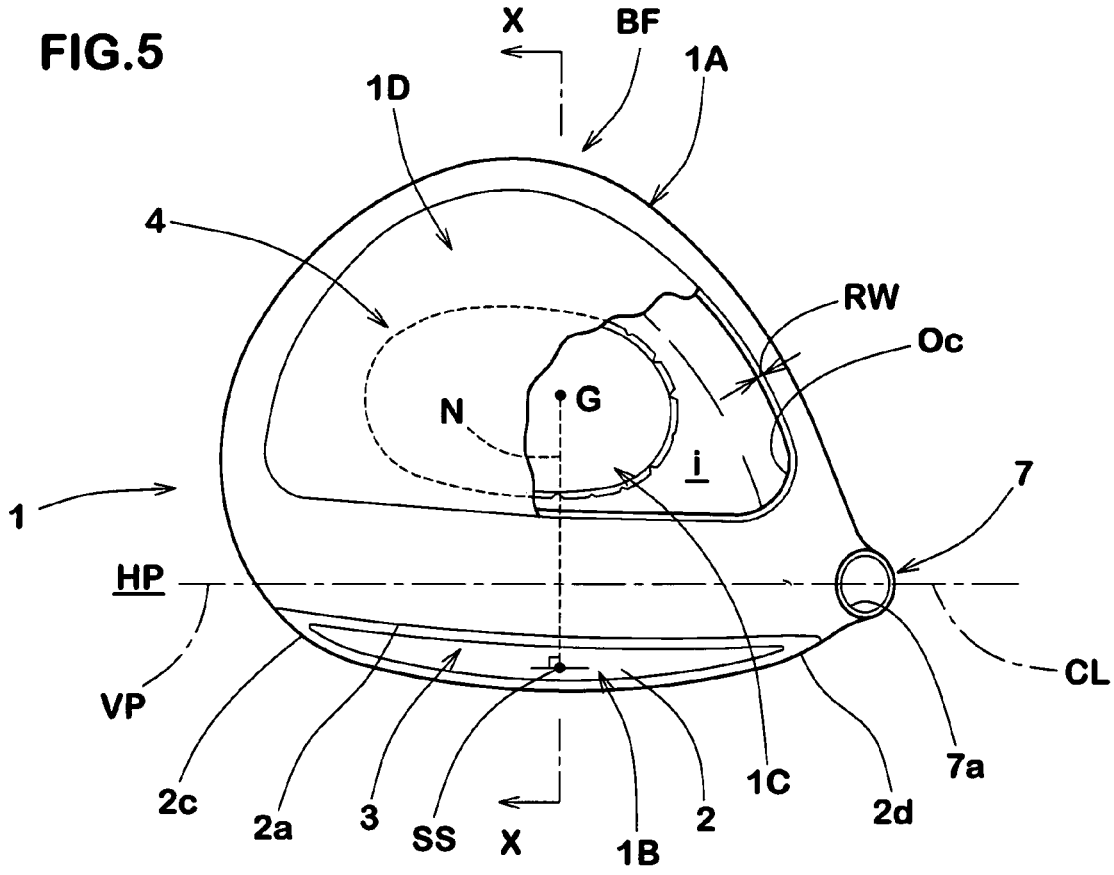
FIG. 5 is a top view of the second embodiment.

Preferably, the area of the top opening Oc (or crown plate 1D) projected on the horizontal plane HP is more than 30%, more preferably more than 40%, still more preferably more than 50% of the area of the head 1 projected on the horizontal plane HP as shown in FIG. 5.

Figure 6:
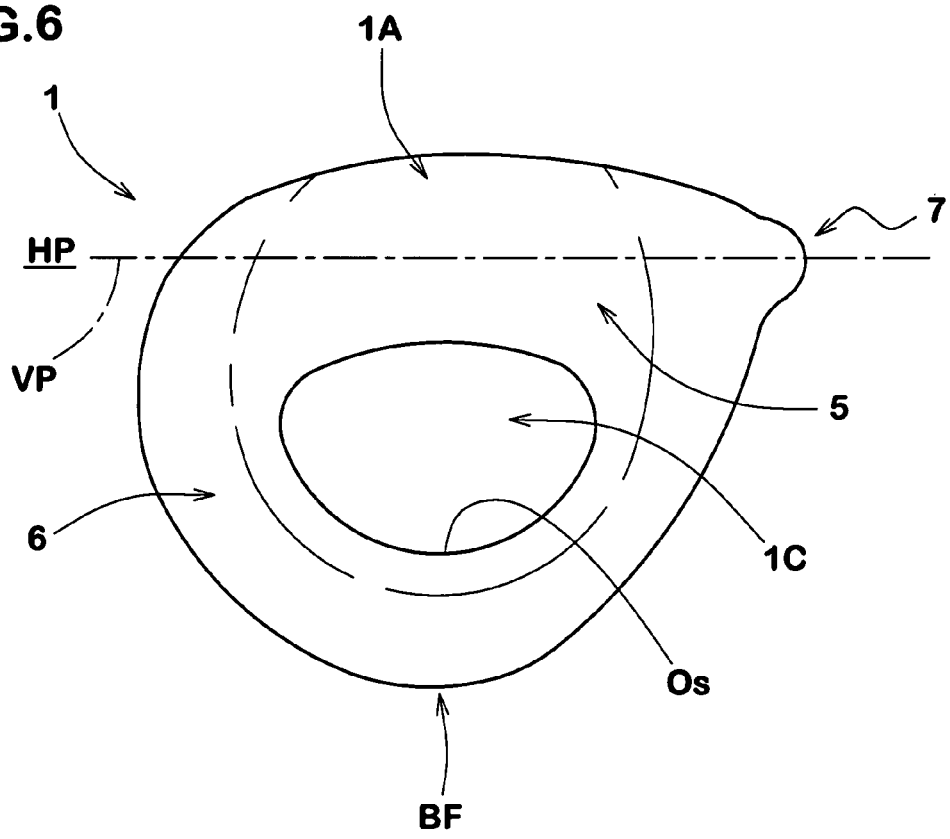
FIG. 6 is a bottom view of the second embodiment.

Preferably, the area of the bottom opening Os (or sole plate 1C) projected on the horizontal plane HP is more than 10%, more preferably more than 15%, still more preferably more than 20% of the area of the head 1 projected on the horizontal plane HP as shown in FIG. FIG. 6. However, expressed on the basis of the sole portion 5, the area of the top opening Oc (or crown plate 1D) projected on the horizontal plane HP is more than about 30%, more preferably more than about 50% of the sole portion 5 projected on the horizontal plane HP.

The main frame 1A can be formed by forging, rolling, bending or the like, but preferably formed by casting specifically lost-wax precision casting in view of the production efficiency.

Figure 7:
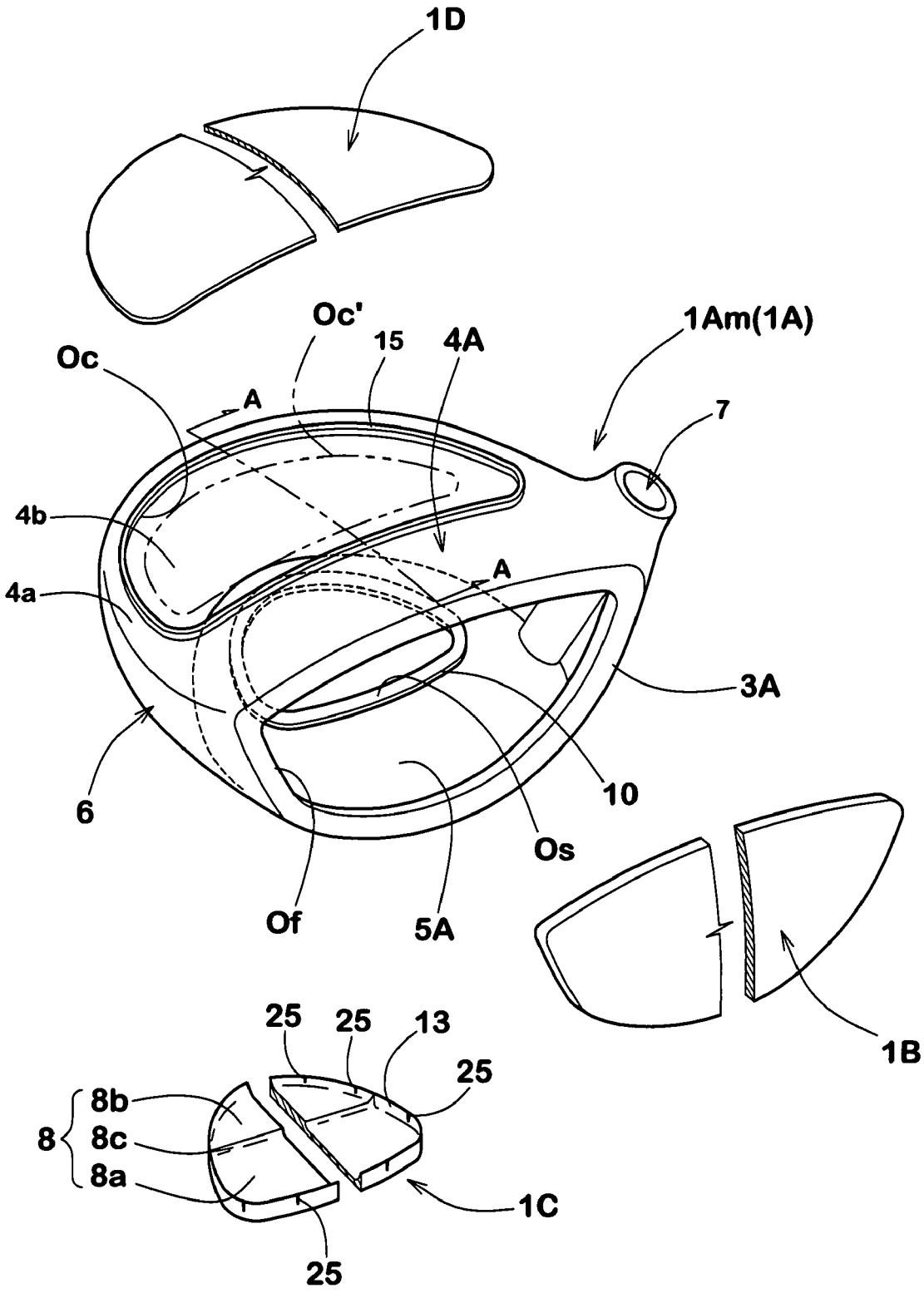
FIG. 7 is an exploded perspective view showing the main frame, crown plate, face plate and sole plate of the second embodiment.

In the two embodiments, as shown in FIG. 7, through a lost-wax process, the main frame 1A is first formed as the primary product 1Am which is not yet provided with the top opening Oc. Then, by means of laser machining, the top opening Oc is formed.

The expression "the crown opening Oc is not yet provided" means that the crown opening Oc with the exact size or shape is not formed in the exact position. Therefore, the primary product 1Am is (1) a casting provided with no opening in the crown portion, or (2) a casting provided with an opening Oc' smaller than the target crown opening Oc as shown in FIG. 7 by an imaginary line.

In either case, along the edge 15*ae* of the crown opening Oc to be formed, a thickness-increased part 15 is molded. This thickness-increased part 15 protrudes from the outer surface of the crown portion 4, and also protrudes from the outside to the inside of the edge 15*ae* of the crown opening Oc to be formed, as shown in FIG. 8 to the right thereof.

Then, through the use of laser beam machining, the crown opening Oc is formed on the primary product 1Am.

Figure 8:
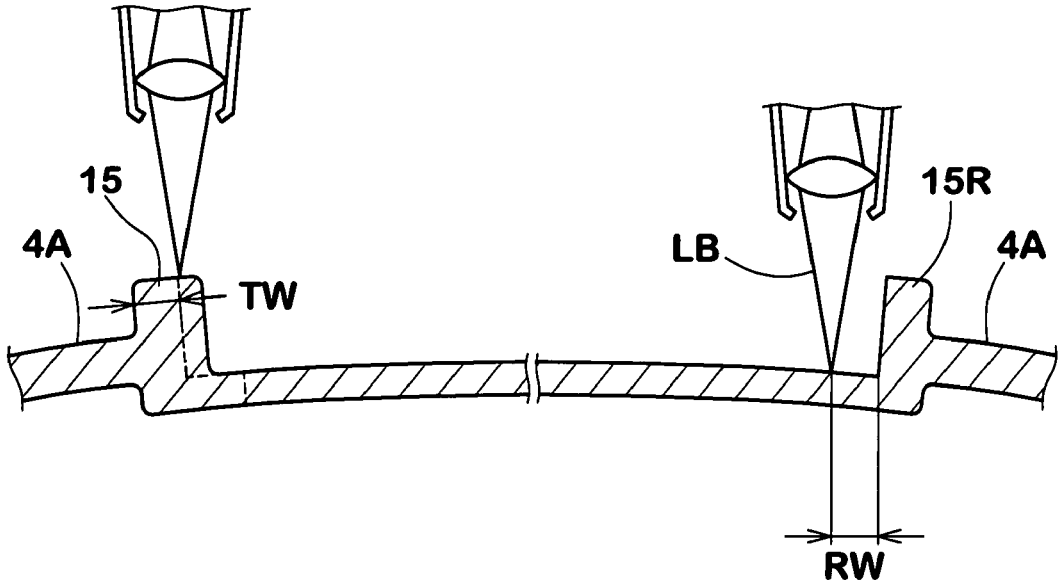
FIGS. 8 and 9 are enlarged cross sectional views for explaining a process of forming a top opening.
Figure 9:
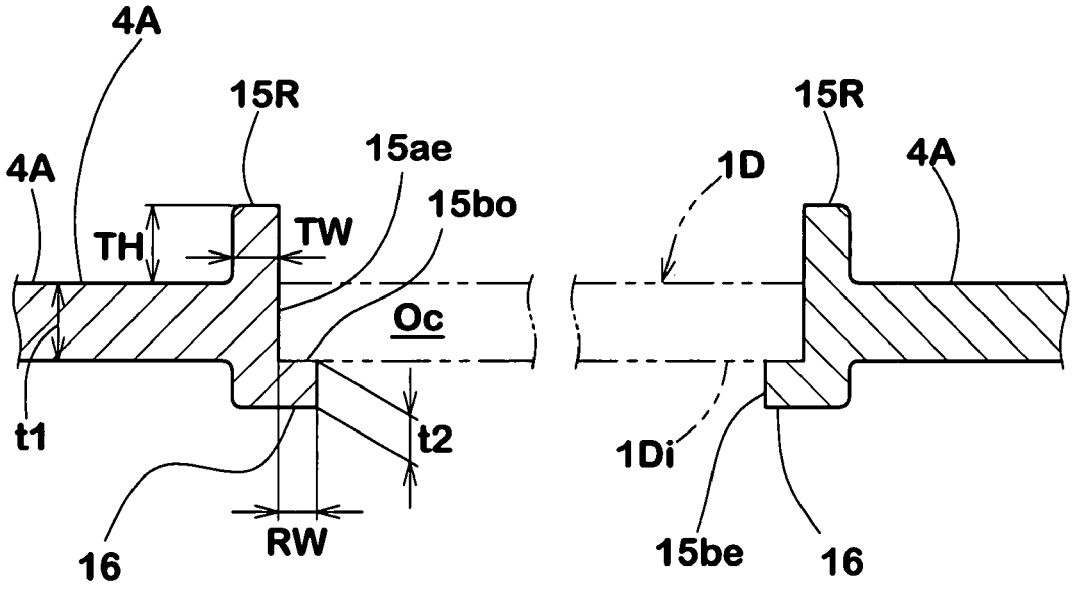

In this laser beam machining process, as shown in FIG. 8, a laser beam LB is irradiated to the thickness-increased part 15, and the edge 15*ae* of the crown opening Oc is formed. As a result, by the remainder of the thickness-increased part 15, a rib 15R is formed along the edge 15*ae* of the crown opening Oc.

Since the thickness t1 of the crown peripheral part 4A is very small (about 0.5 to about 2.0 mm), if there is no rib 15R, the depth of the opening or hole in which the very thin crown plate 1D is fitted becomes very shallow. Accordingly, the crown plate 1D is easy to dislocate during assembling the head. However, by providing the rib 15R, such dislocation can be prevented. It is therefore, preferable that the maximum height TH of the rib 15R is at least 0.5 mm. But, in order to remove the rib from the finished head without consuming time, it is preferable that the maximum height TH is less than about 1.0 mm. For the same reason, the maximum width TW of the rib 15R is preferably about 0.6 mm to about 1.2 mm.

The rib 15R extends continuously and annularly along the edge 15*ae* of the crown opening Oc, but it is also possible to form the rib 15R discontinuously.

Further, by the use of the laser beam machining, the crown-plate support 16 protruding to the crown opening Oc as shown in FIG. 8 is formed. The crown-plate support 16 is prepared for the purpose of temporarily supporting and positioning of the crown plate 1D during welding the crown plate to the main frame. Accordingly, a protrusion RW of at most 1.0 mm is sufficient to such purpose. Preferably, the amount RW of protrusion is set in the range of 0.3 to 0.8 mm.

In order that the width RW satisfies the above limitation, by irradiating the laser beam LB at the position corresponding to RW, the inner edge or side face 15*be* of the crown-plate support 16 is formed.

Furthermore, by the laser beam machining, the outer face 15*bo* of the crown-plate support 16 on which the crown plate 1D is placed is formed at a certain depth so that the outer surface of the crown plate 1D becomes substantially flush with the outer surface of the crown peripheral part 4A when the crown plate 1D is fitted in the crown opening Oc.

As the width RW and the depth of the outer face 15*bo* are very small, it is very difficult to form the crown-plate support 16 with precision by the casting method only without utilizing the laser beam machining.

In this example, the crown-plate support 16 is continuous along the edge 15*ae* of the crown opening Oc. However, the crown-plate support 16 can be discontinuous along the edge 15*ae* of the crown opening Oc.

The maximum thickness t2 of the crown-plate support 16 is preferably at least 0.60 mm, but at most 0.85 mm. To secure the thickness t2, the above-mentioned thickness-increased part 15 also protrudes inwards from the inner surface of the crown peripheral part 4A.

Face Plate 1B

In the first embodiment, as briefly explained above, the face plate 1B is provided around its main part 20 with the turnback 21, wherein the main part 20 forms the entirety of the face portion 3, and the turnback 21 extends backwards from the peripheral edge (2*a*, 2*b*, 2*c*, 2*d*, 2*d*) of the club face 2 preferably including at least the edges 2*a* and 2*b*.

In the second embodiment, the face plate 1B is an almost flat plate having a shape capable of fitting into the front opening of. Thus, the face portion 3 is formed by the face plate 1B and the above-mentioned clubface peripheral part 3A.

In any case, it is desirable that the face plate 1B forms not less than 60%, preferably not less than 70% of the area of the clubface 2, including the sweet spot SS.

The thickness tf of the face portion 3 is preferably set in a range of not less than 2.0 mm, more preferably not less than 2.5 mm, still more preferably not less than 3.0 mm in order to provide durability against impact, but not more than 4.0 mm, more preferably not more than 3.5 mm, still more preferably not more than 3.3 mm in view of the weight balance, the center of gravity and the moment of inertia.

The thickness tf can be substantially constant throughout the face portion 3, but it is also possible to vary for example such that a reduced-thickness part surrounds the resultant thicker central part in order to improve the rebound performance.

The face plate 1B can be formed by die forging the metal material.

In the first embodiment, the rear edge of the turnback 21 is butt welded to the front edge of the main frame 1A. As the turnback 21 keeps the weld position at a distance from the face portion 3, the provision of the turnback 21 is desirable in view of the rebound performance and durability of the face portion 3. In the second embodiment, the face plate 1B is fitted in the front opening of and the peripheral edge is welded to the main frame 1A. Preferably, laser welding is employed in either case since the heat affected zone can be narrowed.

Crown Plate 1D

The crown plate 1D is a metal plate slightly curved convexly and having a shape capable of fitting into the top opening Oc. The crown plate 1D has a substantially constant thickness tc in a range of not less than 0.30 mm, preferably not less than 0.35 mm in view of the strength and durability, but not more than 1.0 mm, preferably not more than 0.75 mm, more preferably not more than 0.60 mm in order to lower the center of gravity G of the club head.

The crown plate 1D in this example is formed from a rolled metal plate through processes of punching out, die pressing, edge trimming and the like. But, it is also possible to employ another method such as casting, forging or the like.

After the sole plate 1*c* is fixed to the main frame as described hereinafter, the crown plate 1D is fitted in the top opening Oc of the main frame 1A, and fixed to the main frame 1A by means of welding. Since the crown plate 1D is very thin, laser welding is preferably employed. In this example, therefore, by utilizing laser welding, the edge of the crown plate 1D is butt welded to the edge 15*ae* of the crown opening Oc of the main frame 1A.

In the case of laser welding, due to the pinpoint irradiation, if the gap between the crown plate 1D and the crown opening Oc is wide, it is difficult to weld. To achieve an effective wilding, the gap should be as small as possible. Accordingly, with respect to the shape, the crown opening as well as the crown plate has to be formed with a high degree of accuracy. Therefore, in this embodiment, lasering is utilized to form the crown opening Oc as described above.

Figure 10:
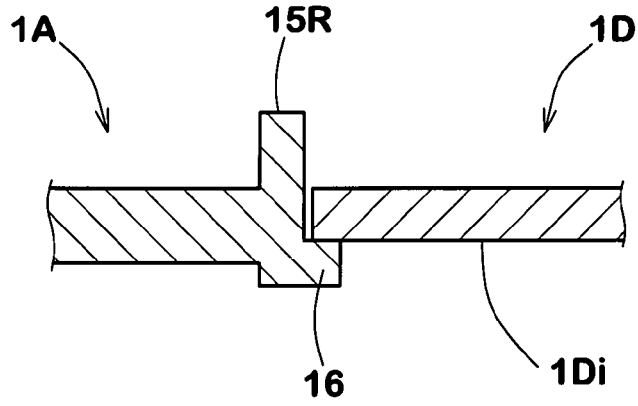
FIGS. 10, 11 and 12 are enlarged cross sectional views for explaining a process of fixing the crown plate to the main frame.

As shown in FIG. 10, the crown-plate support 16, which has been formed to have the outer surface 15*bo* set back from the outer surface of the crown peripheral part 4A, protrudes by the small amount RW. When the crown plate 1D is fitted in the crown opening Oc, the inside face 1Di of the crown plate 1D comes into contact with the outer surface 15*bo*, and the crown plate 1D is temporarily supported in place such that the outer surface of the crown plate 1D becomes substantially flush with the outer surface of the crown peripheral part 4A.

Figure 11:
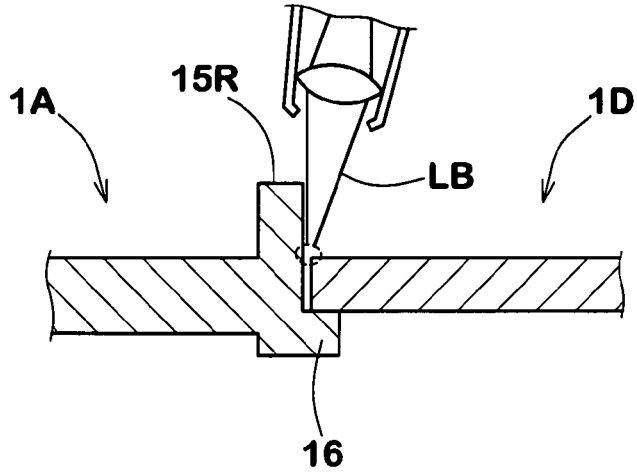

As shown in FIG. 11, from the outside of the head 1, a laser beam LB is irradiated towards the micro gap between the edge of the crown plate 1D and the edge 15*ae* of the crown opening Oc.

Figure 12:
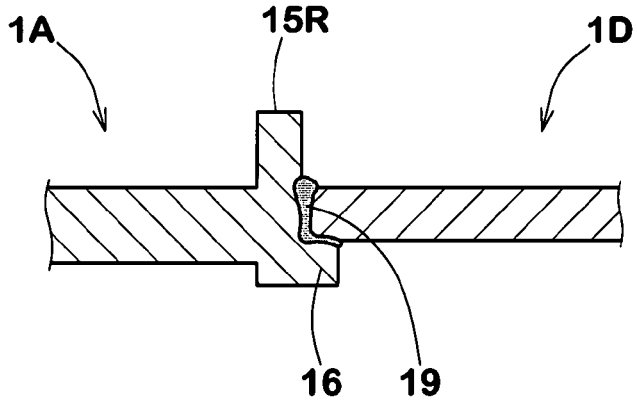

AS shown in FIG. 12, the fused metal fills the micro gap, and penetrates into the interface between the crown plate 1D and the crown-plate support 16 because the width RW is small. As a result, the fusion zone 19 is formed substantially all over the interface.

During irradiating the laser beam LB, the above-mentioned rib 15 facilitates to lessen the heat transmitted to the crown peripheral part 4A. Further, the fused rib is utilized as the filler metal material between the gap. Usually, the rib 15 is removed by machining after the crown plate 1D is welded.

Incidentally, in the laser welding and laser beam machining, high-power laser, carbon dioxide laser, especially preferably YAG laser is preferably used.

Sole Plate 1C

The sole plate 1C comprises: a main plate 8 which has a shape capable of fitting into the bottom opening Os (namely, the shape is almost same but very slightly smaller than the shape of the opening Os); and an anti-pullout part 9 which protrudes radially outwardly from the peripheral edge of the inner surface of the main plate 8 onto the inner surface of an edge portion 10 around the bottom opening Os.

In order to deepen the center G of gravity of the head, it is preferable that the thickness of the main plate 8 is gradually increased from the front end to the rear end thereof. Either a continuous change or a stepped change for example two steps or three steps or more is possible. In this example, therefore, the main plate 8 is made up of a front portion 8*a* having an almost constant thickness ts1, a rear portion 8*b* having an almost constant thickness ts2 more than the thickness ts1, and a variable thickness portion 8*c* therebetween whose thickness changes from ts1 to ts2.

The maximum thickness ts2 of the main plate 8 is not less than 0.8 mm, but preferably not more than 4.0 mm, more preferably not more than 3.0 mm, still more preferably not more than 2.0 mm.

The anti-pullout part 9 in this example is formed continuously around the main plate 8. Thus, the total length of the anti-pullout part 9 measured along the edge of the bottom opening Os is 100% of the circumference of the bottom opening Os. But, it will be sufficient that the anti-pullout part 9 is formed discontinuously if the total length is more than 70% of the circumference.

The amount E of protrusion of the anti-pullout part 9 from the edge 12 of the bottom opening Os is preferably not less than 2.0 mm, more preferably not less than 2.5 mm. It is preferable that the amount E of protrusion is not more than the width of the edge portion 10.

The sole plate 1C is fixed to the main frame 1A by utilizing a caulking process so that the outer circumferential surface 8*e* of the main plate 8 is press fitted to the inner circumferential surface 12 of the bottom opening Os.

Here, the term "caulking" process means such a process that one or each of two parts to be fixed to each other is plastic deformed, and by utilizing the resultant frictional force and/or geometrical engagement between the two parts, the two parts are fixed to each other.

The sole plate 1*c* can be formed by casting for example. The primary product is almost same as the sole plate 1*c* assembled in the finished head, excepting the anti-pullout part 9.

Figure 13:
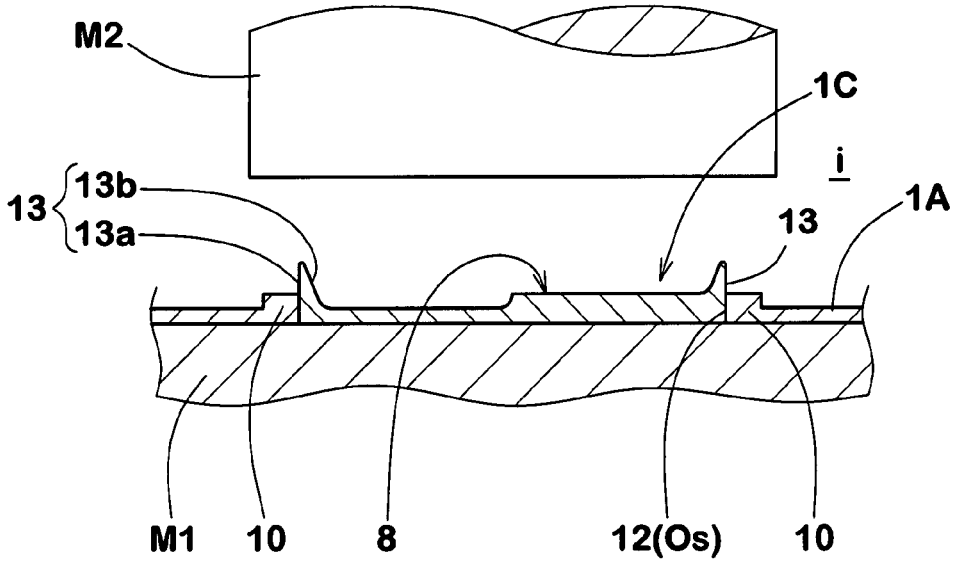
FIGS. 13, 14 and 15 are cross sectional views for explaining a process of fixing the sole plate to the main frame.
Figure 14:
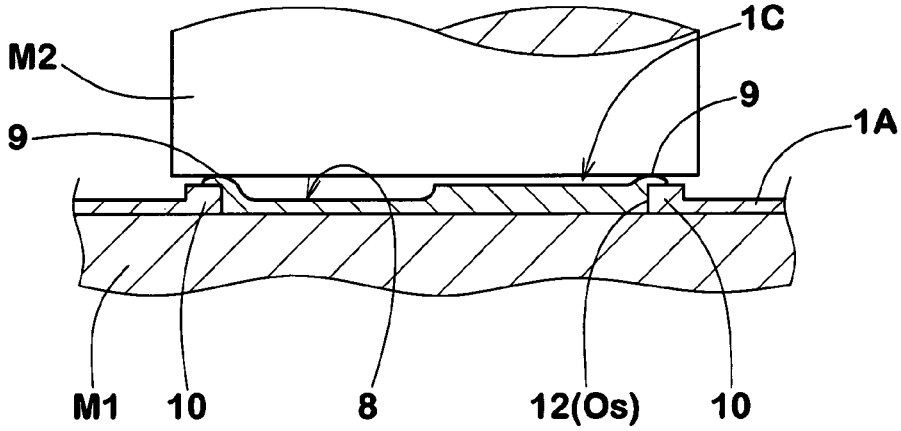
Figure 15:
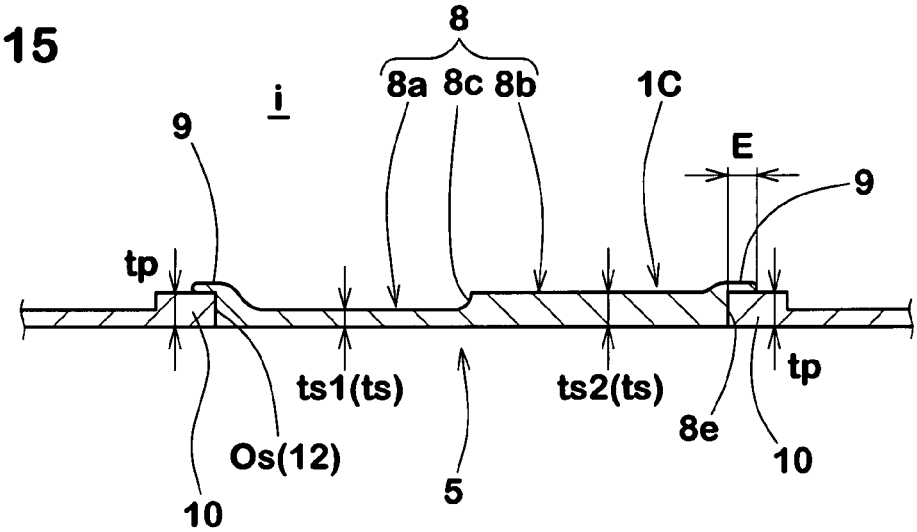

The anti-pullout part 9 is first formed as a protrusion 13 towards the inside of the head, rather than toward the edge portion 10. More specifically, when the sole plate 1*c* is put on a horizontal plane inside-up as shown in FIG. 13, the protrusion 13 is rising up substantially vertically, and the outer circumferential surface 13*a* of the protrusion 13 becomes flush with the outer circumferential surface of the main plate 8. The inner circumferential surface 13*b* of the protrusion 13 extends upwards, while inclining towards the outer circumferential surface 13*a*. Thus, the protrusion 13 is tapered toward the upper end.

The main frame 1A with the sole plate 1*c* whose main plate 8 is fitted in the bottom opening Os is put on a substantially flat face of a lower die M1 so as to support the outer surface of the sole portion inclusive of the outer surface of the main plate 8 as shown in FIG. 13.

An upper die M2 is inserted in the main frame 1A, passing through the top opening Oc.

Using the upper die M2, the protrusion 13 is pressed against the lower die M1 and crashed between the dies so that the protrusion 13 causes a plastic deformation onto the edge portion 10 and forms the anti-pullout part 9. To facilitate such plastic deformation, the protrusion 13 is, as shown in FIG. 7, preferably provided with slits 25 at intervals along the length of the protrusion 13.

With the crashing of the protrusion 13, the peripheral edge portion of the main plate 8 expands and is press fitted to the inner circumferential surface 12 of the bottom opening Os. To facilitate the crashing operation, it is desirable that, when viewed the main frame 1A from above as shown in FIG. 5, the bottom opening Os is located within the top opening Oc.

If the thickness tp of the edge portion 10 around the bottom opening Os is too small, the edge portion 10 is very liable to deform during caulking operation. Therefore, the thickness tp of the edge portion 10 is set in a range of not less than 1.5 mm, preferably not less than 2.0 mm, but preferably not more than 3.0 mm. The ratio (tp/ts2) of the thickness tp to the maximum thickness ts2 of the sole plate 1*c* is not less than 1.0, preferably not less than 1.5, more preferably not less than 1.6, but not more than 2.5, preferably not more than 2.0.

Proof Stress

As the sole plate 1C and the main frame 1A are subjected to such caulking operation, the material of the sole plate 1C has to have a proof stress less than that of the main frame 1A in order to minimize the plastic deformation of the main frame 1A. Therefore, the ratio (YSm/YSs) of the proof stress YSm of the main frame 1A to the proof stress YSs of the sole plate 1C is preferably not less than 1.20, more preferably not less than 1.40. If the ratio (YSm/YSs) is too large, however, YSs becomes relatively small, and the sole plate 1C becomes very liable to be deformed during normal use. Therefore, the ratio (YSm/YSs) is preferably not more than 3.30, more preferably not more than 3.00.

In this application, the proof stress is measured according to Japanese Industrial standards Z2241 "Metallic materials Tensile Testing", and Z2201 "Test pieces for tensile test for metallic materials". More specifically, using test pieces having a shape and dimensions specified as "13B Test piece" in JIS-Z2201, the stress when the permanent elongation became 0.2% was measured by the offset method specified in JIS-Z2241, wherein the speed of testing rate of stressing (the crosshead speed of the tensile testing machine) was 1.0 mm/min.

If the proof stress YSs is too small, it is difficult to maintain necessary durability. If too large, the caulking operation becomes difficult. Therefore, the proof stress YSs of the sole plate 1C is preferably set in a range of not less than 260 MPa, more preferably not less than 300 MPa, still more preferably not less than 350 MPa, but not more than 700 MPa, more preferably not more than 650 MPa, still more preferably not more than 600 MPa.

The proof stress YSm of the main frame 1A is preferably not less than 700 MPa, more preferably not less than 750 MPa in view of the durability of the club head. However, in view of the workability and crack prevention, preferably the proof stress YSm is not more than 1000 MPa, more preferably not more than 950 MPa.

Further, in the case of the face plate 1B, in order to withstand repeated impacts at the time of hitting a ball, the proof stress YSf of the face plate 1B is preferably not less than 1000 MPa, more preferably not less than 1100 MPa. But, it is preferably not more than 1300 MPa, more preferably not more than 1250 MPa because if the proof stress is too large, the workability (esp. plastic forming) becomes worse, and further, the specific gravity becomes increased as a nature of such metal material.

Preferably, the ratio (YSf/YSm) is not less than 1.00, more preferably not less than 1.10, but not more than 1.75, more preferably not more than 1.65. If less than 1.00, there is a tendency that the durability of the head become insufficient in the face portion 3. If more than 1.75, contrary, the durability of the main frame 1A is liable to become insufficient. Likewise, the ratio (YSf/YSs) is preferably not less than 1.15, more preferably not less than 1.50, but preferably not more than 4.30, more preferably not more than 3.50

Specific Gravity

Further, it is preferable that the specific gravities SGm, SGf, SGs and SGc of the main frame 1A, face plate 1B, sole plate 1C and crown plate 1D, respectively, satisfy the following conditions.

If the ratio (SGs/SGm) is less than 1.50, when a higher percentage of the weight is allocated to the sole-portion, the thickness of the sole plate 1C is becomes very large, and as a result, the center of gravity of the sole plate 1C becomes higher, which nullifies the lowering of the center of gravity. If the ratio (SGs/SGm) is more than 2.25, the workability of the sole plate 1C is liable to become worse, and it becomes hard to caulk. Therefore, the ratio (SGs/SGm) is preferably set in a range of not less than 1.50, more preferably not less than 1.75, but not more than 2.25, more preferably not more than 2.10.

If the ratio (SGs/SGf) is less than 1.47, there is a tendency that the lowering of the center of gravity is nullified as in the above case. If the ratio (SGs/SGf) is more than 2.30, the workability of the sole plate 1C is liable to become worse.

Therefore, the ratio (SGs/SGf) is preferably set in a range of not less than 1.47, more preferably not less than 1.55, but not more than 2.30, more preferably not more than 2.15.

If the ratio (SGm/SGf) is less than 1.00, it becomes difficult to deepen the center of gravity of the head. Therefore, the ratio (SGm/SGf) is preferably set in a range of not less than 1.00, more preferably not less than 1.01, but not more than 1.05, more preferably not more than 1.03.

Furthermore, in view of the strength and durability of the head, the specific gravity SGm of the main frame 1A is preferably set in a range of not less than 4.40, but not more than 4.55 in order to reduce the head weight and thereby to increase the head volume.

The specific gravity SGc of the crown plate 1D is preferably set in a range of not less than 4.0, more preferably not less than 4.4 in order to reduce the weight, but not more than 5.0, more preferably not more than 4.8.

The specific gravity SGs of the sole plate 1C is preferably set in a range of not less than 6.0, more preferably not less than 6.5, still more preferably not less than 7.0 in order to lower the center of gravity, but not more than 10.0 in view of swing balance.

The specific gravity SGf of the face plate 1B is preferably set in a range of not less than 4.30 for the strength and durability, but not more than 4.50 in view of lowering of the center of gravity of the head.

Metal Materials

Metal materials which satisfy the above ranges of the proof stress YSs and specific gravity SGs and thus which can be suitably used for the sole plate 1C, are stainless steels, e.g.

SUS630 (proof stress: 800 MPa, specific gravity: 7.80),

SUS255 (proof stress: 550 MPa, specific gravity: 7.75),

SUS431 (proof stress: 410 MPa, specific gravity: 7.73),

SUS304 (proof stress: 300 MPa, specific gravity: 7.93) and the like.

Aside from the stainless steels, damping alloys having a large specific gravity and a high damping performance are preferably used. For the damping performance, it is desirable that the logarithmic decrement (delta) is in a range of not less than 0.21, preferably not less than 0.25, more preferably not less than 0.35, but preferably not more than 0.90, more preferably not more than 0.70. Here, the logarithmic decrement is measured by mechanical impedance method (central vibrating method), using a 1 mm×10 mm×160 mm specimen, at a room temperature and an amplitude distortion of 5×10^−4.

Especially preferred is a Mn-base damping alloy containing 17 to 27 wt % of cu, 2 to 8 wt % of Ni, and 1 to 3 wt % of Fe, and the other ingredients are Mn and obligatory impurities. Of course it is also possible to use another Mn-base damping alloy such as Fe—Al alloys (e.g. Fe-7.5Al to Fe-8.5Al), Ni—Ti alloys and Al—Zn alloys.

In the damping alloys, when an external force is applied, twin crystal easily occurs and the twin boundary is easily moved. Accordingly, the kinetic energy of the applied force is transformed into heat energy. When the force is removed, the twin crystal vanishes. As a result, vibrations are damped. Such damping alloy has superior vibration damping performance and high strength, and further, the workability is high.

As to the metal material of the main frame 1A, preferably used are pure titanium (proof stress: 500 MPa, specific gravity: 4.51) and titanium alloys such as Ti-6Al-4V (proof stress: 900 MPa, specific gravity: 4.42), Ti—Fe—O, e.g. "KS100" made by Kobe steel, Ltd. (proof stress: 600 MPa, specific gravity: 4.51), and Ti—Fe—O—Si, e.g. "KS120SI" made by Kobe steel, Ltd. (proof stress: 750 MPa, specific gravity: 4.51).

As to the metal material of the face plate 1B, preferably used are titanium alloys such as Ti-5.5Al-1Fe(proof stress: 1000 MPa, specific gravity: 4.38) and Ti-6Al-4V(proof stress: 900 MPa, specific gravity: 4.42).

AS to the metal material of the crown plate 1D, preferably used are titanium alloys such as Ti-15V-3Cr-3Al-3Sn(proof stress: 1200 MPa, specific gravity 4.76).

Soldering

By the caulking operation, the peripheral edge portion of the main plate 8 is press fitted to the inner circumferential surface 12 of the bottom opening Os. But, there is a possibility that micro gaps exist therebetween. Therefore, to bridge the gaps and also for the purpose of increasing the bonding strength between the main plate 8 and main frame 1A, soldering is made on the outside of the head so that the solder is drawn into the gaps between the main plate 8 and main frame 1A by capillary action.

After caulking, for example, the main frame 1A is held upside-down, and the solder in the form of paste or powder is applied to the boundary between the sole plate 1*c* and the main frame 1A.

In order that only the solder is fuzzed and files the macro gaps, the vicinity of the boundary is heated in vacuo or in an inert gas since the titanium alloy has high activity. As to the heating method, high-frequency induction heating is preferably employed.

In the case of a combination of a titanium alloy (main frame) and stainless steel (sole plate) as in this embodiment, silver solder, aluminum solder, titanium solder or the like can be used. But, preferably, silver solders such as Ag-15Cu, Ag-7.5Cu-0.2Li, Ag-20Cu-2Ni-0.4Li, Ag-28Cu-0.2Li, Ag-22Cu-17Zn-5Sn, Ag-3Li, Ag-27Cu-5Ti or the like can be used.

Incidentally, before the soldering operation, soldering flux such as borax, boric acid, boron, fluorides and chloride is applied to the boundary and heated to remove oxide from the surfaces to be soldered. Of course, it is also possible that the soldering flux and the solder can be applied and heated at the same time.

Comparison Tests

The following wood-type hollow metal heads for driver (volume 435 cc, weight 195.0 grams) were prepared and comparison tests were conducted as follows.

Working Example Heads:

Ex.1, Ex.3 and Ex.4 had structures based on FIGS. 3 to 7.

Ex.2 had a structure based on FIGS. 1 and 2.

Comparative Example Heads:

Ref. 1 had a structure similar to FIGS. 1 and 2 but the bottom opening was omitted.

Ref. 2 had a structure similar to FIGS. 3 to 7 but the bottom opening and top opening were omitted.

In each of Ex.1-Ex.4, the top opening of the main frame was formed by laser machining as explained above, and the sole plate was fixed to the main frame by means of caulking and soldering as explained above, and the face plate and crown plate were welded to the main frame using carbon dioxide laser. In all of the heads including working examples and Comparative examples, the thickness tf of the face portion was 3.2 mm. Other specifications are shown in Table 1.

In Table 1, the height of the center of gravity indicates the vertical height of the sweet spot SS measured from the above-mentioned horizontal plane HP under the standard state. The depth of the center of gravity indicates the horizontal distance measured perpendicularly to the vertical plane VP from the extreme front end (lower-edge 2*b*) of the face portion to the center G of gravity under the standard state.

The right-and-left moment of inertia is the moment of inertia around a vertical axis passing through the center of gravity of the head, the vertical moment of inertia is the moment of inertia around a horizontal axis passing through the center of gravity of the head and extending parallel with both of the horizontal plane HP and the vertical plane VP, and those were measured with a moment of inertia measuring instrument "MODEL No. 005-002" manufactured by INERTIA DYNAMICS Inc.

Hit Feeling Test:

Ten golfers each hit identical balls six times per head, and hit feeling of each of the heads was evaluated into five ranks—Rank 5: best (small shock, softest hit feeling)—Rank 1: bad (large shock, hardest hit feeling). The mean values of the rank numbers are indicated in Table 1.

Durability Test:

45-inch wood-type golf clubs were made by attaching the club heads to identical carbon shafts "V-25(Flex: X)" manufactured by SRI sports Limited. Each golf club was mounted on a swing robot and hit golf balls at the sweet spot SS of the club face at a head speed of 54 meter/second in succession, and the club head was checked for damage every 500 hits with the naked eye. The number of hits at which any damage was observed was recorded together with the kind of the damage and indicated in Table 1.

Rebound Performance Test:

According to the "Procedure for Measuring the velocity Ratio of a club Head for conformance to Rule 4-1e, Appendix II, Revision 2 (Feb. 8, 1999), united states Golf Association", the restitution coefficient (e) of each club head was obtained. The results are shown in Table 1. The larger the value, the better the rebound performance.

The invention claimed is:

1. A method for manufacturing a hollow golf club head comprising the steps of:

preparing a main frame made of a metal material and provided with a top opening and a bottom opening, wherein the main frame is provided along the edge of the top opening with a rib so that the rib has an edge being flush with the edge of the top opening and protrudes from the outer surface of the crown portion around the top opening, and the step of preparing the main frame includes casting the main frame as a primary product not provided with the top opening, forming the top opening by means of lasering, and making said edge of the rib and the edge of the top opening by laser beam machining so that the edges become flush with each other;

preparing a crown plate made of a metal material;

preparing a sole plate made of a metal material, wherein the specific gravity SGs of the metal material of the sole plate is larger than the specific gravity SGm of the metal material of the main frame, and the proof stress YSs of the metal material of the sole plate is smaller than the proof stress YSm of the metal material of the main frame, and the sole plate comprises a main part which can almost fit to the bottom opening, and a protrusion formed at the peripheral edge of an inner surface of the main part so as to protrude from a part of said inner surface surrounded by the protrusion, and

TABLE 1

| Club head | Ex. 1 | Ex. 2 | Ex. 3 | Ex. 4 | Ref. 1 | Ref. 2 |
|---|---|---|---|---|---|---|
| Main frame | Ti—6Al—4V | Ti—6Al—4V | Ti—6Al—4V | Ti—6Al—4V | Ti—6Al—4V | Ti—6Al—4V |
| SGm | 4.42 | 4.42 | 4.42 | 4.42 | 4.42 | 4.42 |
| YSm (MPa) | 900 | 900 | 900 | 900 | 900 | 900 |
| Crown plate | 15-3—3-3Ti | 15-3—3-3Ti | 15-3—3-3Ti | 15-3—3-3Ti | 15-3—3-3Ti | — |
| Face plate | Ti—6Al—4V | Ti—5.5Al—1Fe | Ti—6Al—4V | Ti—6Al—4V | Ti—5.5Al—1Fe | Ti—6Al—4V |
| SGf | 4.42 | 4.38 | 4.42 | 4.42 | 4.38 | 4.42 |
| YSf (MPa) | 900 | 1000 | 900 | 900 | 1000 | 900 |
| Sole plate *1 | SUS630 | SUS630 | D2052 | SUS304 | — | — |
| SGs | 7.78 | 7.78 | 7.25 | 7.93 | — | — |
| YSs (MPa) | 800 | 800 | 300 | 300 | — | — |
| SGm/SGf | 1.00 | 1.01 | 1.00 | 1.00 | 1.01 | 1.00 |
| SGs/SGm | 1.76 | 1.76 | 1.64 | 1.79 | — | — |
| SGs/SGf | 1.76 | 1.78 | 1.64 | 1.79 | — | — |
| YSf/YSs | 1.13 | 1.25 | 3.00 | 3.00 | — | — |
| YSm/YSs | 1.13 | 1.13 | 3.00 | 3.00 | — | — |
| YSf/YSm | 1.00 | 1.11 | 1.00 | 1.00 | 1.11 | 1.00 |
| ts/tp | 0.48 | 0.60 | 0.50 | 0.64 | — | — |
| ts (mm) | 1.20 | 1.50 | 1.50 | 1.80 | — | — |
| tp (mm) | 2.50 | 2.50 | 3.00 | 2.80 | — | — |
| Test Results | | | | | | |
| Center of gravity | | | | | | |
| Height (mm) | 34.0 | 33.8 | 34.4 | 34.1 | 35.0 | 36.0 |
| Depth (mm) | 37.6 | 37.5 | 37.5 | 38.0 | 36.5 | 35.3 |
| Moment of inertia | | | | | | |
| Right-Left (g sq · cm) | 4250 | 4200 | 4160 | 4150 | 4100 | 4150 |
| Vertical (g sq · cm) | 2760 | 2850 | 2750 | 2770 | 2600 | 2430 |
| Hit feeling | 3.8 | 3.7 | 4.5 | 4.1 | 3.7 | 3.1 |
| Durability | | | | | | |
| Number of hits | 11000 | 22000 | 10000 | 10000 | 24000 | 10500 |
| Damage | face crack | face crack | face crack | face crack | face crack | face crack |
| Restitution coefficient | 0.823 | 0.821 | 0.825 | 0.819 | 0.822 | 0.821 |

*1 Composition SUS630: Fe—17Cr—4Ni—3Cu—Nb SUS304: Fe—18Cr—8Ni D2052: Mn—22.3Cu—5.1Ni—2.0Fe (Mn-base damping alloy)

the step of preparing the sole plate includes providing slits for the protrusion which slits are arranged at intervals along the length of the protrusion;

placing the sole plate in the bottom opening of the main frame so that the protrusion protrudes from the inner surface of an edge portion of the main frame around the bottom opening;

inserting a die into the inside of the main frame through the top opening;

caulking the sole plate by crushing the protrusion of the sole plate onto said edge portion around the bottom opening, by the use of the inserted die;

placing the crown plate in the top opening of the main frame; and fixing the crown plate to the main frame by utilizing laser welding, wherein the laser beam is irradiated from the outside of the golf club head towards a micro gap between the edge of the crown plate and the edge of the top opening.

2. The method according to claim 1, which further comprises a step of soldering the sole plate and the main frame along their boundary on the outer surface of the head after the caulking.

3. The method according to claim 1, wherein the step of preparing the sole plate includes:

providing a variable thickness for the sole plate which thickness gradually increases from the front to the rear of the head.

4. The method according to claim 1, wherein the step of preparing the main frame includes providing a front opening for the main frame, and the method further comprises the steps of:

preparing a face plate made of a metal material of which specific gravity SGf is not more than the specific gravity SGm of the metal material of the main frame; and fixing the face plate to the main frame so that the face plate covers the front opening.

5. A hollow golf club head manufactured by the method as set forth in claim 4 and comprising a main frame provided with a front opening and a bottom opening and made of a material having a specific gravity SGm and a proof stress YSm, a face plate covering the front opening and made of a material having a specific gravity SGf, and a sole plate covering the sole portion and made of a material having a specific gravity SGs and a proof stress YSs, wherein the specific gravities SGm, SGf and SGs satisfy the following condition:

$$SGf=<SGm<SGs \text{ and}$$

the proof stress YSm and proof stress YSs satisfy the following condition:

$$YSs<YSm.$$

6. The golf club head according claim 5, wherein the sole plate and the main frame are soldered along their boundary on the outer surface of the head.

7. The golf club head according claim 5, wherein the thickness (tp) of the edge part of the main frame around the bottom opening is not less than the thickness (ts) of the main part of the sole plate.

8. The method according to claim 1, wherein the main frame is provided in the top opening with a crown-plate support protruding from the edge of the top opening so as to have an outer surface set back from the outer surface of the crown portion around the top opening and coming into contact with the inner surface of the crown plate placed in the top opening, and the step of fixing the crown plate to the main frame by utilizing laser welding is carried out in a state that the crown plate is placed in the top opening and supported by the crown-plate support.

9. The method according to claim 1, wherein the protruding height TH of the rib is at least 0.5 mm but less than 1.0 mm, and the width TW of the rib is 0.6 mm to 1.2 mm.

10. The method according to claim 8, which further comprises making said crown-plate support by utilizing laser beam machining so that the amount (RW) of protrusion of the crown-plate support from the edge of the top opening becomes at most 1.0 mm.

* * * * *